US006158148A

United States Patent [19]

Krausch

[11] Patent Number: 6,158,148

[45] Date of Patent: Dec. 12, 2000

[54] METHOD FOR DETECTING IMPERMISSIBLE OPERATING STATES IN A HOT-AIR CLOTHES DRYER, AND A DRYER WITH SUCH A DETECTION METHOD

[75] Inventor: Uwe-Jens Krausch, Berlin, Germany

[73] Assignee: BSH Bosch und Siemens Hausgeraete GmbH, Munich, Germany

[21] Appl. No.: 09/109,580

[22] Filed: Jul. 2, 1998

[30] Foreign Application Priority Data

Jul. 2, 1997 [DE] Germany ..... 197 28 197

[51] Int. Cl.[7] ..... F26B 3/00

[52] U.S. Cl. ..... 34/497; 34/499; 34/549

[58] Field of Search ..... 34/77, 467, 468, 34/475, 476, 477, 486, 491, 494, 495, 496, 497, 535, 557, 549, 73, 78, 604, 607, 608, 609, 610

[56] References Cited

U.S. PATENT DOCUMENTS 4,206,552 6/1980 Pomerantz et al. ..... 34/23
4,412,389 11/1983 Krueger ..... 34/46
4,622,759 11/1986 Abe et al. ..... 34/44
5,347,727 9/1994 Kim ..... 34/491
5,367,787 11/1994 Ikeda et al. ..... 34/549
5,649,372 7/1997 Souza ..... 34/491

*Primary Examiner*—Pamela Wilson
*Assistant Examiner*—Michelle A. Mattera
*Attorney, Agent, or Firm*—Herbert L. Lerner; Laurence A. Greenberg; Werner H. Stemer

[57] ABSTRACT

The method detects impermissible operating states in a hot-air clothes dryer with a laundry drum. The temperature in the incoming air flow is detected periodically downstream of an incoming air heater and upstream of the drum. A differential value (difference value or gradient) is formed from two successively detected values. The differential value is compared with a predetermined differential value, and if the newly formed differential value is absolutely greater than the predetermined differential value, then a counting value is incremented by one step. The counting value is compared with a predetermined counting value and, if the current counting value is greater than the predetermined counting value, then the heating of the dryer is turned off and/or an operating state display is activated.

9 Claims, 2 Drawing Sheets

METHOD FOR DETECTING IMPERMISSIBLE OPERATING STATES IN A HOT-AIR CLOTHES DRYER, AND A DRYER WITH SUCH A DETECTION METHOD

BACKGROUND OF THE INVENTION

Field of the Invention

The present invention relates to a method for detecting impermissible operating states in a hot-air clothes dryer, and to a dryer in which such a method is implemented.

In conventional clothes dryers, clothes in a drum that as a rule rotates are dried by passing a flow of heated air through the drum and thus through the clothes, the flow being capable of drawing moisture from the damp clothes, thereby gradually drying the clothes.

The air flow supplied is heated in a supply line upstream of the drum by means of a suitable heating device. After passing through the clothes in the drum, the air is either discharged to the outside (air-exhaust clothes dryer) or delivered to a heat exchanger, in which the air is cooled down and the moisture precipitates out as condensate.

In both types of clothes drying, similar problems arise in terms of safe, reliable dryer operation.

The clothes drying process is such that the incoming air is heated and flows through the clothes, and depending on the degree of moisture of the clothes and on the temperature of the air itself, the air draws a corresponding quantity of moisture from the clothes. It is a requirement that after the clothes attain a certain degree of dryness, excessive heating of the incoming air stream and thus both overheating of the clothes on the one hand and overheating of the dryer itself on the other are avoided.

In the prior art, many solutions to this problem have been offered but in the final analysis have proved unsatisfactory.

There has become known from German published non-prosecuted patent application DE 16 10 314 a method for automatically controlling the drying process until a desired degree of dryness is attained. This is effected as a function of gradients in the rising temperature in a clothes drying system, in which during or at the end of the drying process the difference between the temperature of the incoming air and the outgoing air is ascertained, and the change over time in this difference is utilized as a criterion for turning off the heating device. This method requires at least two temperature sensors with corresponding control, and the controller does not turn off the heating process until permissible maximum temperature values are exceeded.

U.S. Pat. No. 4,412,389 (German patent DE 30 30 864 C2) discloses a method for automatically controlling the drying process in a clothes drying system and a device for performing the method. There, a suitable length of operation is calculated in comparison with an imagined period of operation of the drying process, and the drying process is controlled accordingly.

However, that prior art process is disadvantageous in that the drying process is not turned off until permissible operating states are attained, and hence it is not reliably possible to preclude possible damage to both the clothes and the dryer appliance.

SUMMARY OF THE INVENTION

It is accordingly an object of the invention to provide a method of detecting impermissible operating states in a hot-air clothes dryer, which overcomes the above-mentioned disadvantages of the heretofore-known devices and methods of this general type and which allows the dependable detection of an impermissible operating state well before a critical operating state is reached, and allows the selected suppression of such an operating state, if needed, well before it is actually reached.

With the foregoing and other objects in view there is provided, in accordance with the invention, a method for detecting impermissible operating states in a hot-air clothes dryer, which comprises:

Periodically detecting a temperature of an incoming air flow between an incoming air heater and a laundry drum of a hot-air clothes dryer;

determining an actual differential value from two successively detected values of the incoming air temperature;

comparing the actual differential value with a predetermined differential value; and if the actual differential value is absolutely greater than the predetermined differential value, incrementing a counting value by one step, comparing the counting value with a predetermined counting value, and, if the counting value is greater than the predetermined counting value, turning off the incoming air heater and/or activating an operating state display.

The term differential value as noted above is defined as an arithmetic difference value ($\theta 1-\theta 1$) or as a time gradient ($\theta/t$) change of the temperature. In the latter case, the actual differential value in the determining step is a gradient of the incoming air temperature, and the predetermined differential value in the determining step is a predetermined gradient.

It is a further object of the invention to propose a corresponding clothes dryer, in which impermissible operating states are detected and can be suppressed in good time.

With this and other objects in view there is provided, in accordance with the invention, a hot-air clothes dryer, comprising:

a laundry drum for receiving clothes to be dried;

a blower communicating with the laundry drum for generating an air flow through the clothes to be dried;

a heater for heating the air flow;

a temperature sensor exposed to the air flow between the heater and the laundry drum; and a controller connected to the temperature sensor and the heater for detecting and responding to impermissible operating states of the dryer, the controller being programmed to perform the method described and claimed herein.

Impermissible operating states caused by possible overheating are thus averted with the invention. By selecting the predetermined values, the state of the dryer can already be detected far below the critical temperature level, and an early shutoff of the heater can be accomplished, thereby achieving substantially greater safety of the appliance in terms of avoiding heat damage.

A further result is that a reduction in the number of structural parts is attainable compared with conventional dryers. In particular, up to two heating stages can be omitted.

With the method of the invention, it is possible either separately or even jointly to detect various operating states involving excessively high temperature that originate in different regions.

For instance, overheating of the incoming air flow per se can be ascertained in general, or such a risk of overheating can be detected early before the excessively high temperature is reached, and suitable counter-measures can be executed, in particular the shutoff of the heater. As a result, damage to structural parts as well as to the clothes in the dryer can be reliably averted.

Instead of or in addition to the detection of the pure overheating value of the incoming air, however, it is also possible to detect a clogged lint filter by the method of the invention, because an impermissibly clogged lint filter causes a corresponding increase in the temperature of the air flow because of reduced flow speed or increased flow resistance in the appliance. For the same heating capacity, higher temperatures are reached faster and are detected according to the method of the invention leading to heater shutoff in a good time. Moreover, a display of the invention of a clogged lint filter can be activated beforehand.

Highly advantageously, the method of the invention can be used both in condensation dryers and in air-exhaust dryers, so that it can be used universally.

In accordance with an added feature of the invention, the step of periodically detecting comprises measuring the temperature of the incoming air flow from a beginning of a drying process onward. The entire temperature course and behavior in the dryer is thus detected.

In accordance with another feature of the invention, a first predetermined permissible differential value is defined to correspond to a still-permissible differential overheating value.

In accordance with an additional feature of the invention, if the current differential value is less than the permissible differential overheating value, the current differential value is compared with a second predetermined permissible differential temperature value, which corresponds to a permissible temperature increase occurring as a consequence of lint filter clogging.

In accordance with a further feature of the invention, if the current differential value is less than the permissible lint filter differential temperature value, then a lint filter counting value is incremented by a counting value, the increased lint filter counting value is compared with a predetermined lint filter counting value, and, if the increased lint filter counting value is greater than the predetermined lint filter counting value, an indication is given that the lint filter is clogged, for instance by activating a display indicating lint filter clogging to a user.

In accordance with a concomitant feature of the invention, the predetermined permissible differential value is defined to correspond to a differential temperature value corresponding to a permissible degree of lint filter clogging.

The method for detecting impermissible operating states in a clothes dryer has a control process in which the measured values are compared with predetermined values in accordance with a flow chart. Advantageously, differential temperature values (gradients) detected periodically in succession are compared with at least one permissible differential overheating value (gradient). If it is found as a result that the ascertained differential value is less than the permissible differential overheating value or gradient value, then advantageously this current differential value is compared with a second predetermined permissible differential value, which corresponds to a permissible temperature increase that results from lint filter clogging.

If it is found that the ascertained differential value is less than the permissible lint filter differential temperature value, then the lint filter counting value is incremented by a counting value, the newly formed lint filter counting value is compared with a predetermined lint filter counting value, and, if the newly formed lint filter counting value is greater than the predetermined lint filter counting value, the display "lint filter clogged" is activated.

The advantageous result of this is in particular that in the two-stage method, both overheating of the incoming air flow on the one hand and lint filter clogging on the other are detected, so that not only can the heater of the clothes dryer be turned off in good time but in addition a signal is available that indicates lint filter clogging in good time. Accordingly, the user of the dryer is in a position to perform lint filter cleaning appropriately, and, on the basis of suitably preselected values, a display telling the user to clean the lint filter can be made long before the filter becomes completely clogged, and thus the dryer can always operate in a satisfactory, energy-saving operating state.

Other features which are considered as characteristic for the invention are set forth in the appended claims.

Although the invention is illustrated and described herein as embodied in a method for detecting impermissible operating states in a hot-air clothes dryer, as well as a dryer with such a detection method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
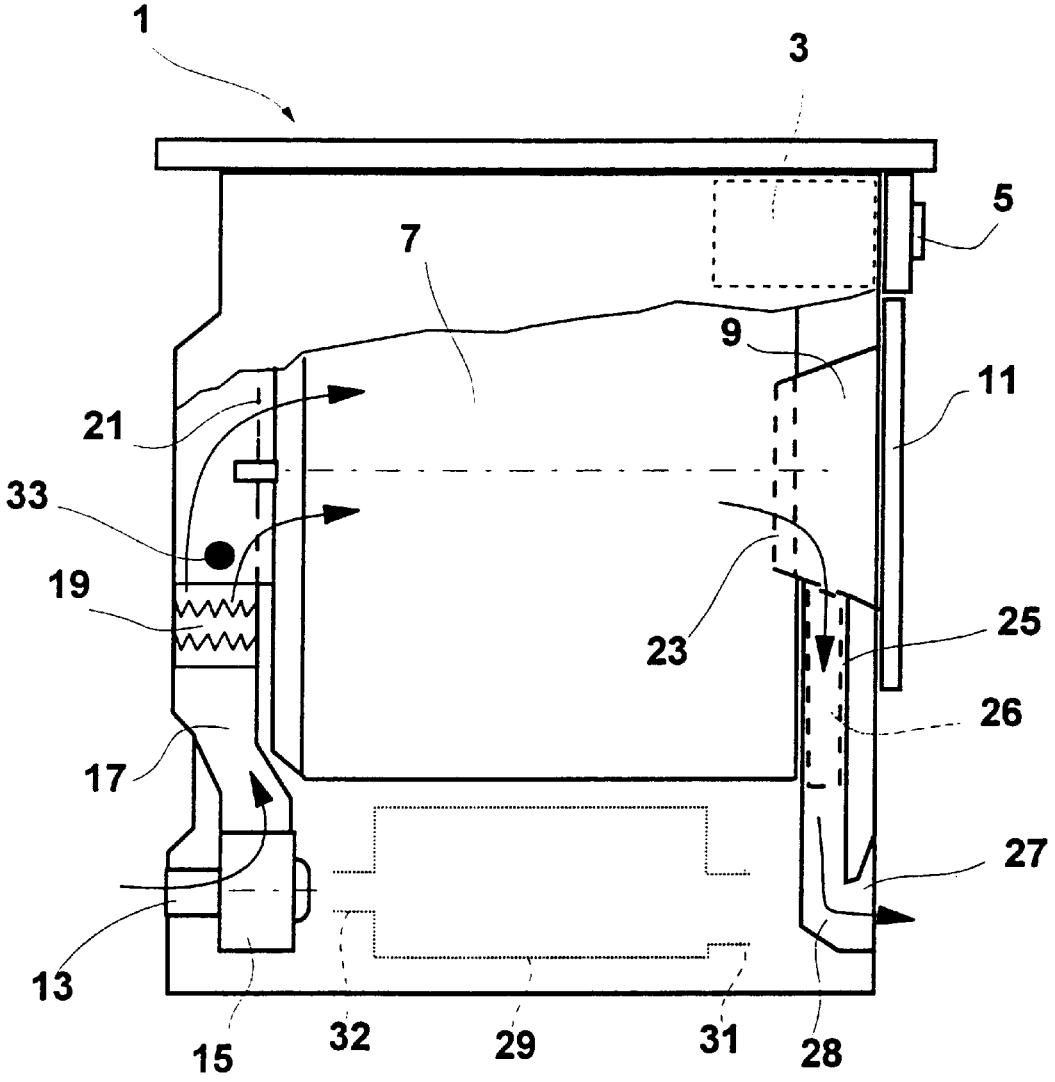
FIG. 1 is a partial sectional view through a clothes dryer, illustrating both an air-exhaust type clothes dryer (solid lines) and a condensation-type clothes dryer operating on the air-recirculation principle (dashed lines)

Referring now to the figures of the drawing in detail and first, particularly, to FIG. 1 thereof, there is seen a clothes dryer 1 according to the invention. The dryer has a program control device 3 in its upper portion, which can be set using a knob 5. In a best mode embodiment, the program control device 3 includes a non-illustrated fuzzy processor controller.

The dryer has a typical laundry drum 7, which is accessible via a port 9 from a filling door 11, and by way of which the clothes can be placed in the drum 7 and removed therefrom after the drying process.

An air inlet opening 13 is disposed at the lower back side of the dryer 1. Air is aspirated through the opening 13 from outside via a blower 15, which causes the air to flow into an incoming air conduit 17. From the incoming air conduit 17, the fresh incoming air flows via a heater 19 on to an inlet 21 of the drum 7. The incoming air flows through the drum 7 and at the outlet 23 flows through an outgoing air conduit 25 and a lint filter 26, placed in this outgoing air conduit, to an outgoing air outlet 27, from which it flows out into the open air. The dryer 1 thus described accordingly operates on the air-exhaust principle.

However, the drying air circuit can also be closed in order to form an air-recirculation type clothes dryer. In that case, the outgoing air is carried from the outgoing air conduit 25 to a condenser 29. The condenser 29 is embodied as a heat exchanger, in which the moist outgoing air is cooled down and the increased moisture in the air is correspondingly condensed. This air is then fed back into the incoming air conduit 17 through the blower 15. The condensate may be removed from the dryer at a suitable point, in a way not shown, or pumped into a condensate container from which it can be removed by hand.

Structurally, to form a condensation clothes dryer operating by the air-recirculation principle, the elbow 28 of the outgoing air conduit 25 and the blower 15 are reversed and connected to the respective stubs 31 and 32 of the condenser 29.

A temperature sensor 33 is disposed in the air conduit above the heater 19. At predetermined time intervals, the sensor 33 periodically detects the temperature of the air and delivers a proportional signal representing the measured value to a suitable control device.

Figure 2:
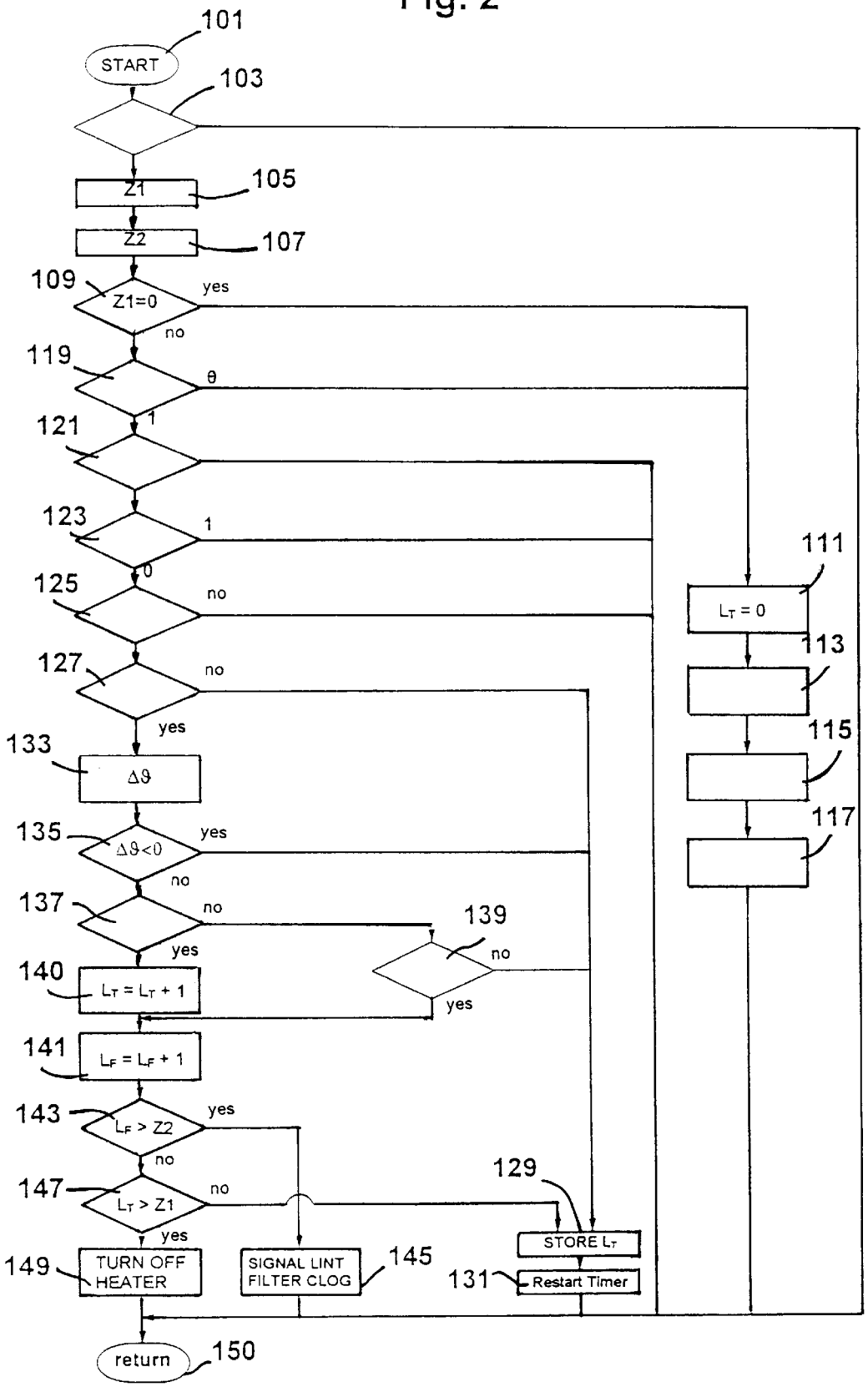
FIG. 2 is a flow chart illustrating the two-stage process of the novel detection method, in which both overheating of the incoming air flow on the one hand and lint filter clogging on the other are indicated or used to control the heater.

Reference will now be made to FIG. 2 for a detailed description of the method of the invention: There is shown a block diagram which illustrates the course of the method of the invention for detecting impermissible operating states. Control begins in step 101, in which a detected differential temperature value or temperature gradient is delivered to the controller for processing. In a step 103, the differential value of step 101 is tested whether it is within an acceptable range. If not, the program returns to the start.

In step 105, a value Z1 is read in that corresponds to the permissible counting value $L_T$ of the temperature before the overheating. In step 107, a value Z2 is read in that corresponds to a permissible counting value $L_F$ before the lint filter clogging that is to be signaled.

Step 109 provides a query whether or not Z1 is equal to zero. If so, then the program continues in a step 111, which initiates the shutoff of the gradient method, by setting the counting value $L_T$ for the temperature equal to zero. After that, in a step 113, the counter is set to zero, and in a step 115 the counting value of the periodic temperature measurement is likewise set to zero. In a step 117, an overheating signal is then likewise set to zero, and the program returns to the start.

If in step 109 the value Z1 is not equal to zero, then in a step 119 a query tests whether the dryer has started. If not, the program continues with steps 113 to 117 and then returns to the start. If the dryer is active, then in a subsequent step 121 the question is asked whether the lint filter signal has already been set. If so, the program returns to the start. If not, then in a step 123 the question is asked whether the overheating signal or the lint filter overheating signal has been set. If so, the program returns to the start. If not, then in a next step 125, the question is asked whether the set timer has already run out, or not. If it has not yet run out, then the program again returns to the start. However, if the timer has already run out, then the program continues in a step 127, in which the question is asked whether an old temperature value $L_T$ is already present. If not, then the current temperature value $L_T$ is stored in memory as the starting temperature value (step 129), and the timer is restarted (step 131). After that, the program returns to the start, and a second temperature value is ascertained.

However, if an old value is already present, then the program continues after step 127 in step 133, in which a temperature difference $\Delta\theta$ or a temperature gradient $\theta/t$ is set. In a following step 135 the question is asked whether the temperature difference $\Delta\theta$ is less than zero. If so, then the program continues in step 129. If not, the program continues in step 137, in which the question is asked whether $\Delta\theta$ is greater than the permissible differential overheating value, or not. If not, then in a following step 139 the question is asked whether $\Delta\theta$ is greater than a differential value of the differential value resulting from clogging of the lint filter. If not, then the program continues in step 129. If so, then the program continues in step 141, in which the counting value for lint filter clogging $L_F$ is increased or incremented by one.

If it is found in step 137 that the current differential temperature value $\Delta\theta$ or gradient $\theta/t$ is greater than the permissible differential overheating value, then in a following step 140, before step 141, the counting value $L_T$ for overheating is increased or incremented by one. In a step 143, the question is asked whether the counting value $L_F$ is greater than the permissible counting value Z2. If so, then the program continues in step 145, in which the lint filter signal is set and the "clogging" display is set to blinking. This indicates the status of a clogged lint filter to the user. The program then returns to the start. If the value is less than Z2, then in a following step 147 the question is asked whether the counting value $L_T$ is greater than the permissible counting value Z1 for overheating. If not, the program continues in step 129. If so, then in a step 149 the overheating signal is set to "one", and the heater is correspondingly turned off. After that, the program returns to the start via step 150.

As can be seen from the above description, in a preferred embodiment of the method of the invention both the overheating of the incoming air flow is ascertained, with the aid of a first gradient comparison, and possible line filter clogging, in a second gradient comparison, are ascertained. It is understood that the two detection methods can also be performed separately and independently of one another, or only one of the two methods may be implemented in a corresponding clothes dryer.

With the method according to the invention for detecting impermissible operating states in a clothes dryer, the possibility is thus advantageously created of detecting the status of the dryer from a temperature increase already long before an excessive temperature has actually been attained. Accordingly, the heater can be turned off in good time before the excessive temperature is reached. Thus not only the components of the dryer per se but also the laundry in the drum are reliably protected against overheating. Instead of lint filter clogging or in addition to it, it is also possible by the method of the invention to detect any other hindrance to the air flow within the air guide conduits.

I claim:

1. A method for detecting impermissible operating states in a hot-air clothes dryer, which comprises:

periodically detecting a temperature of an incoming air flow between an incoming air heater and a laundry drum of a hot-air clothes dryer;

determining an actual differential value from two successively detected values of the incoming air temperatures;

comparing the actual differential value with a predetermined differential value; and if the actual differential value is absolutely greater than the predetermined differential value, incrementing a counting value by one step, comparing the counting value with a predetermined counting value, and, if the counting value is greater than the predetermined counting value, at least one of turning off the incoming air heater and activating an operating state display.

2. The method according to claim 1, wherein the actual differential value in the determining step is a gradient of the incoming air temperature, and the predetermined differential value in the determining step is a predetermined gradient.

3. The method according to claim 1, wherein the periodically detecting step comprises measuring the temperature of the incoming air flow from a beginning of a drying process onward.

4. The method according to claim 1, which comprises defining a first predetermined permissible differential value to correspond to a still-permissible differential overheating value.

5. The method according to claim 4, which further comprises, if the current differential value is less than the permissible differential overheating value, comparing the current differential value with a second predetermined permissible differential temperature value, which corresponds to a permissible temperature increase occurring as a consequence of lint filter clogging.

6. The method according to claim 5, which further comprises, if the current differential value is less than the permissible lint filter differential temperature value, incrementing a lint filter counting value by a counting value, comparing the increased lint filter counting value with a predetermined lint filter counting value, and, if the increased lint filter counting value is greater than the predetermined lint filter counting value, indicating that the lint filter is clogged.

7. The method according to claim 6, wherein the indicated step comprises activating a display indicating lint filter clogging to a user.

8. The method according to claim 1, which further comprises defining the predetermined permissible differential value to correspond to a differential temperature value corresponding to a permissible degree of lint filter clogging.

9. A hot-air clothes dryer, comprising:

a laundry drum for receiving clothes to be dried;

a blower communicating with said laundry drum for generating an air flow through the clothes to be dried;

a heater for heating the air flow;

a temperature sensor exposed to the air flow between said heater and said laundry drum; and a controller connected to said temperature sensor and said heater for detecting and responding to impermissible operating states of the dryer, said controller being programmed to perform the method of claim 1.

* * * * *